US006597094B2

(12) United States Patent
Meissner et al.

(10) Patent No.: US 6,597,094 B2
(45) Date of Patent: Jul. 22, 2003

(54) COLOR DISPLAY TUBE WITH IMPROVED SUSPENSION OF THE COLOR SELECTION ELECTRODE

(75) Inventors: Jörg Meissner, Eindhoven (NL); Piet Christiaan Jozef Van Rens, Eindhoven (NL); Hendrik Pancratius Maria Bergmans, Veldhoven (NL); Wilhelmus Marinus Maria Van De Steen, Eindhoven (NL); Arnoldus Antonius Maria Hendriks, Eindhoven (NL); Jan Harmannus Post, Eindhoven (NL); Hernes Jacobs, Breda (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 142 days.

(21) Appl. No.: 09/846,419

(22) Filed: May 1, 2001

(65) Prior Publication Data

US 2002/0021073 A1 Feb. 21, 2002

(30) Foreign Application Priority Data

May 2, 2000 (EP) ..... 00201581

(51) Int. Cl.[7] ..... H01J 29/80

(52) U.S. Cl. ..... 313/404; 313/402; 313/405; 313/406; 313/407

(58) Field of Search ..... 313/402, 404–407

(56) References Cited

U.S. PATENT DOCUMENTS 4,730,142 A * 3/1988 Brunn
4,763,039 A 8/1988 Van Rens et al. ..... 313/406
4,876,477 A * 10/1989 De Deugd et al.
4,884,005 A * 11/1989 Kornaker et al.
4,987,337 A * 1/1991 Bongenaar et al.
5,003,218 A * 3/1991 Gijrath et al.
5,233,266 A * 8/1993 Spina et al.
5,982,085 A * 11/1999 Lakshmanan et al.
6,316,870 B1 * 11/2001 Hendriks et al.

* cited by examiner

*Primary Examiner*—Nimeshkumar D. Patel
*Assistant Examiner*—Anthony Perry

(57) ABSTRACT

A color display tube (1) is disclosed, which comprises an improved suspension system of the color selection electrode (12). The color display tube has suspension means that are constructed so as to be self-locking. The suspension means (20) are provided with an additional flat portion (31). This plate has an aperture (32) that is shaped such that it has at least three surfaces of engagement (42, 43) for the free end portion (22) of the supporting elements (17) connected to the inside of the upright edge (18) of the display window (3). When the color display tube is exposed to shock loading, the construction of the flat portion (31) is capable of absorbing this shock without the color selection electrode (12) becoming detached from the supporting elements (17). The action is based on the friction between the surfaces of engagement (42) and the free end portion (22). When a force is applied in the plane (47) of the resilient element (30), the suspension means (20) slip from their rest position and are locked by a surface of engagement (48), whereby the preload caused by the resilient element (30) and the spring (40) will cause the suspension means (20) to resume its original position. In this manner, a color display tube (1) with a good positional stability of the color selection electrode (12) is obtained. Furthermore, the color selection electrode (12) can be reclaimed in case the color display tube (1) is rejected because there is no need to weld the suspension means (20) to the free end portions (22) anymore.

20 Claims, 8 Drawing Sheets

COLOR DISPLAY TUBE WITH IMPROVED SUSPENSION OF THE COLOR SELECTION ELECTRODE

The invention relates to a colour display tube comprising a display window with a circumferential upright edge and corner areas, a colour selection electrode comprising corner sections to which suspension means, comprising a resilient element having a flat portion incorporating an apertured part with an entrance opening, are coupled, which colour selection electrode is suspended in the corner areas from supporting elements each having a free end portion engaging the apertured part at at least three contact points, which are located on surfaces of engagement, the free end portion having a centre which substantially coincides with a plane through the flat portion, the apertured part being formed so that at least one of the contact points is situated outside the plane of the flat portion, on the side facing away from the free end portion.

The invention also relates to a corner section for use in a colour selection electrode of such a colour display tube and to a colour selection electrode provided with such a corner section.

A colour display tube as described in the opening paragraph is disclosed in U.S. Pat. No. 4,763,039. The colour display tube according to this specification is provided with a colour selection electrode, which is suspended in the corners of the display window. In this corner suspension system, the supporting elements, which are connected in the corners of the upright edge of the display window, are coupled to the suspension means of the colour selection electrode. The suspension means comprise a flat portion, the resilient element and a part with an aperture for receiving the spherically curved free end portion of the supporting elements. This aperture is provided with at least three contact points for engaging the free end portion, at least one contact point being situated outside the plane of the resilient element. Furthermore, the part containing the aperture is provided with a member that acts as a spring to lock the spherically curved free end portion in the aperture of the suspension means. Thus, the aperture and the free end portion act as a detent, locking the individual suspension means to the supporting elements.

The colour selection electrode has to be stabile positioned in the colour display tube to ensure that the picture displayed on the display window always shows the right colours. Instabilities in the position of the colour selection electrode lead to misregistrations of the electron beams impinging on the phosphors of different colours. This will cause discolorations of the picture, resulting in a deterioration of the picture quality.

The colour display tube disclosed in U.S. Pat. No. 4,763,039 has the disadvantage that it has a corner suspension system which requires large forces for clamping the suspension means on the supporting elements. This is necessary in order to fulfil a basic requirement, namely that the colour selection electrode must not become detached from the supporting elements in a finished colour display tube. However, in the production process the high clamping forces lead to loose particles in the colour display tube due to scratching of the spring element along the supporting elements. This high clamping force influences the positional stability of the colour selection electrode in the colour display tube in a negative way because the friction between the supporting elements and the suspension means is considerably increased.

It is an object of the invention to provide a colour display tube having a colour selection electrode with an improved suspension system as compared to the type described in the opening paragraph, which strongly reduces the registration errors on the display window and which leads to a cheaper production process of colour display tubes in the factories.

According to the present invention, this object is achieved by means of a colour display tube, which is characterized in that the surfaces of engagement of contact points that coincide with the plane through the flat portion are substantially perpendicular to said plane, and the surfaces of engagement of contact points that are situated outside said plane are substantially perpendicular to the connection between the contact points and the centre of the free end portion, which free end portion is allowed free passage through the entrance opening of the apertured part.

The invention is based on the insight that by having an entrance opening of the apertured part that is slightly larger than the diameter of the free end portion, the mounting of the colour selection electrode becomes quite easy. The colour selection electrode is positioned by pressing the suspension means on the supporting elements, thereby overcoming only the spring force of the resilient elements. The surface of engagement containing a contact point situated outside the plane through the flat portion makes sure the free end portion is positioned such that its centre substantially coincides with the flat portion. Mechanical shocks exerted on the colour display tube can cause a shift of the colour selection electrode with respect to the display window, but the positioning of the surfaces of engagement in combination with the preload of the spring force of the resilient elements ensures that the colour selection element will resume its original position. As a result, the colour display tube will not be sufficient to misregistrations, thereby improving the picture quality.

Furthermore, as this construction results in a very stable positioning of the colour selection electrode, it becomes superfluous to weld the suspension means to the supporting elements, as is done in currently produced colour display tubes. This makes it possible to reclaim the colour selection electrode if a colour display tube is rejected, and reuse it for the production of another colour display tube, leading to a significant saving in the production centre.

In a preferred embodiment the apertured part is formed so that the coupling between the apertured part and the free end portion is self-locking for forces applied in the direction of the flat portion.

Mechanical shocks exerted on the colour display tube lead to a force in the suspension element that is directed in the flat portion containing the resilient element. In order to prevent that the colour selection electrode becomes detached from the supporting elements, it is important that a self-locking action exists in the direction of the flat portion. For that reason, the surfaces of engagement of the apertured part are arranged so that if a force is applied that is directed in the plane of the flat portion, a shift may occur between the suspension means and the supporting element, but when this force disappears the original position is resumed. In the direction perpendicular to the flat portion, a self-locking action is unwanted, because this makes handling in the production process more difficult. During the manufacture of a colour display tube, the display window is provided—by a photochemical exposure process—with a screen comprising, for instance, a black matrix layer and phosphors of three colours. For the exposure of each of them the colour selection electrode has to be inserted and extracted from the display window. This is most easily done when, in the direction perpendicular to the flat portion, these are no obstructions between the suspension means and the free end portion.

In a further embodiment, a friction force arises between the surfaces of engagement of the contact points that are situated outside the plane of the flat portion and the free end portion when a force is applied in the direction of the flat portion.

When a force is applied in the direction of the plane of the flat portion, the surfaces of engagement having their contact points situated in this plane will have no friction force between them and the free end portions, because the applied force is perpendicular to these surfaces of engagement. However, the surfaces of engagement having their contact points outside the plane of the flat portion are not perpendicular to the applied force, resulting in friction between these surfaces of engagement and the free end portion. This friction is very important for the self-locking function of the suspension system. If the friction is higher, the self-locking function is maintained for higher applied forces as well.

A still further embodiment is characterized in that one contact point is situated outside the plane of the flat portion and two contact points coincides with said plane.

A stable coupling between the suspension means and the free end portion requires at least three contact points. The easiest way to realize this is by using exactly three contact points only one of which is situated outside the plane of the flat portion.

In a still further embodiment, the free end portions are substantially spherically curved. Free end portions of this shape are preferred because they are easy to manufacture and enable a simple way of designing the positions of the surfaces of engagement.

The invention further relates to a corner section of a colour selection electrode for use in a colour display tube according to the present invention and to colour selection electrodes provided with such corner sections.

These and other aspects of the invention will be apparent from and elucidated by means of non-limitative examples with reference to the drawings and the embodiments described hereinafter.

Figure 1:
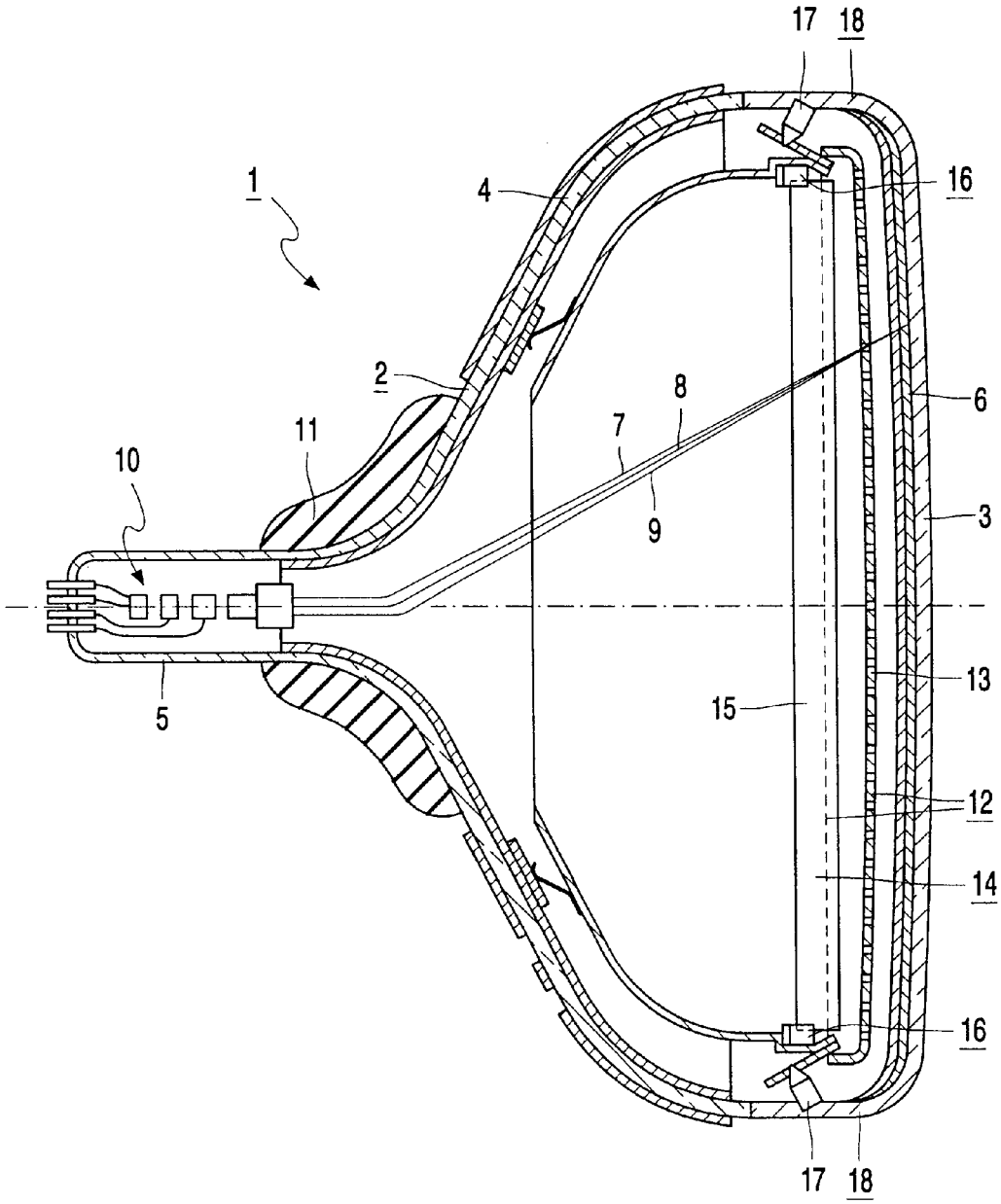
FIG. 1 is a sectional view of a colour display tube according to the invention.

The colour display tube 1 shown in FIG. 1 comprises an evacuated glass envelope 2 with a display window 3, a funnel shaped part 4 and a neck 5. On the inner side of the display window 3, a screen 6 having a pattern of, for example, lines or dots of phosphors luminescing in different colours (e.g. red, green and blue) may be arranged. The phosphor pattern is excited by the three electron beams 7, 8 and 9 that are generated by the electron gun 10. On their way to the screen, the electron beams 7, 8 and 9 are deflected by the deflection unit 11, ensuring that the electron beams 7, 8 and 9 systematically scan the screen 6. Before the electrons hit the screen 6 they pass through a colour selection electrode 12. This colour selection electrode 12 comprises a shadow mask 13, which is the real colour selective part: it intersects the electron beams so that the electrons only hit the phosphor of the appropriate colour. The shadow mask 13 may be a mask having circular or elongate apertures, or a wire mask. Furthermore, the colour selection electrode 12 comprises the frame 14 for supporting the mask. Parts that can be distinguished in the frame 14 are, inter alia, the corner sections 16 and the diaphragm parts 15 interconnecting the corner sections 16.

The colour selection electrode 12 is suspended from the display window 3 by using supporting elements 17, which are secured in the upright edge of the corner areas 18 of the display window 3. This way of suspending the colour selection electrode 12 in a colour display tube 1 will further be referred to as corner suspension.

Figure 2:
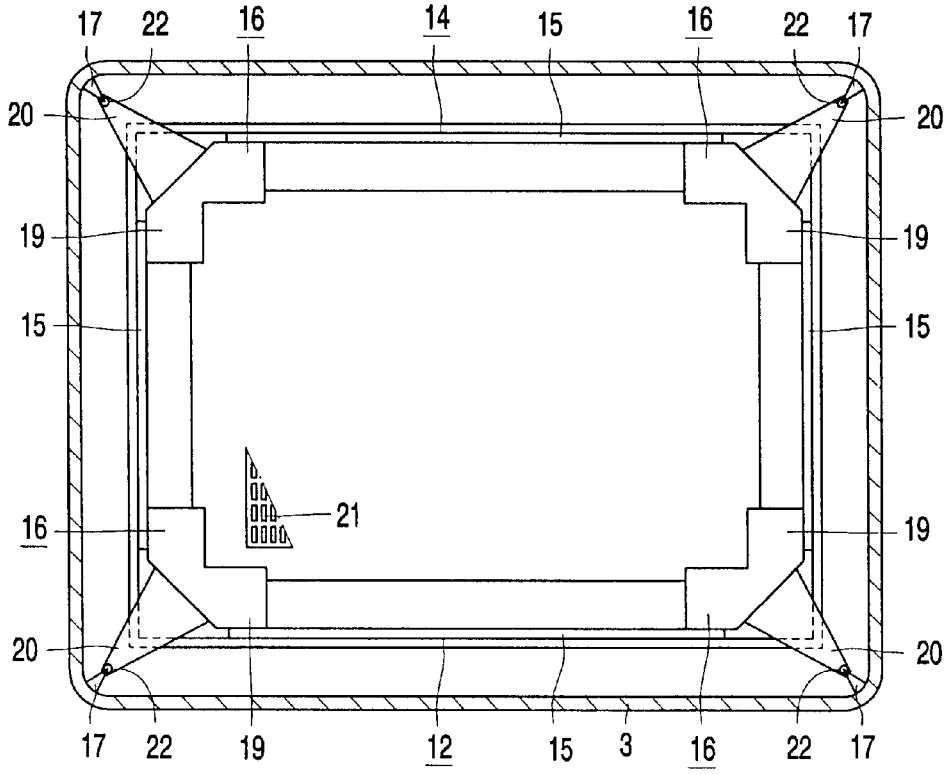
FIG. 2 is a schematic, elevational view of a colour selection electrode mounted in a display window.

In FIG. 2, a schematic, elevational view of a colour selection electrode 12 mounted in a display window 3 is shown. The corner sections 16 in this Figure comprise two major portions, a rigid portion 19 for interconnecting the diaphragm parts 15 and a suspension element 20 for suspending the colour selection electrode 12 from the supporting elements 17 in the display window 3. The shadow mask 13 is coupled to the diaphragm parts 15. The section 21 of the mask, as indicated in FIG. 2, is only meant as an example. During the manufacturing process, the colour selection electrode 12 has to be inserted into and extracted from the display window 3 several times, inter alia for the processes wherein the matrix and the phosphor layers are deposited. In order to meet the demands regarding the required accuracy of the matrix and phosphor patterns, it is necessary that the position of the colour selection electrode 12 can be reproduced very accurately when it is inserted again. This requires a high positional stability of the colour selection electrode 12 in the colour display tube 1.

Figure 3:
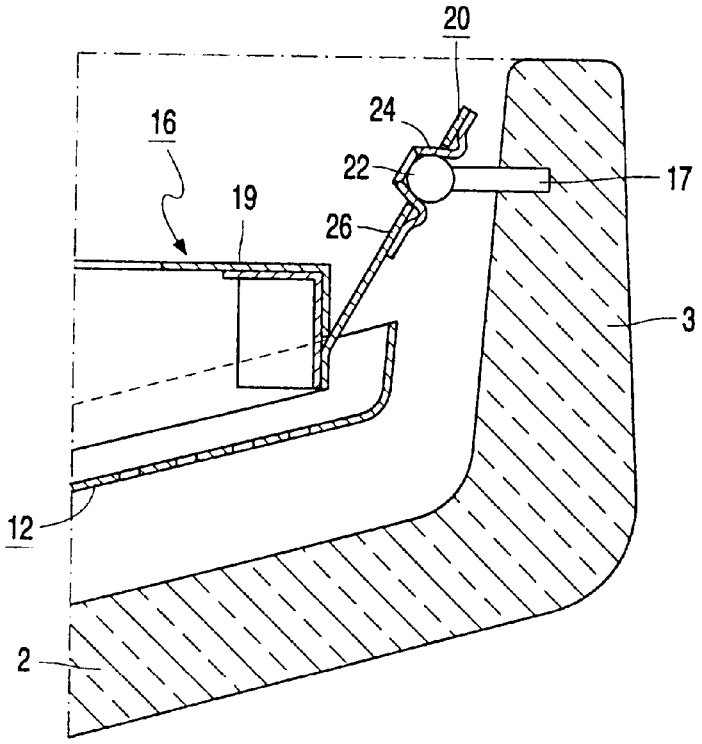
FIG. 3 PRIOR ART
FIG. 3 is a sectional view of a portion of a tube as depicted in FIG. 1, showing the prior-art suspension of a colour selection electrode.
Figure 4:
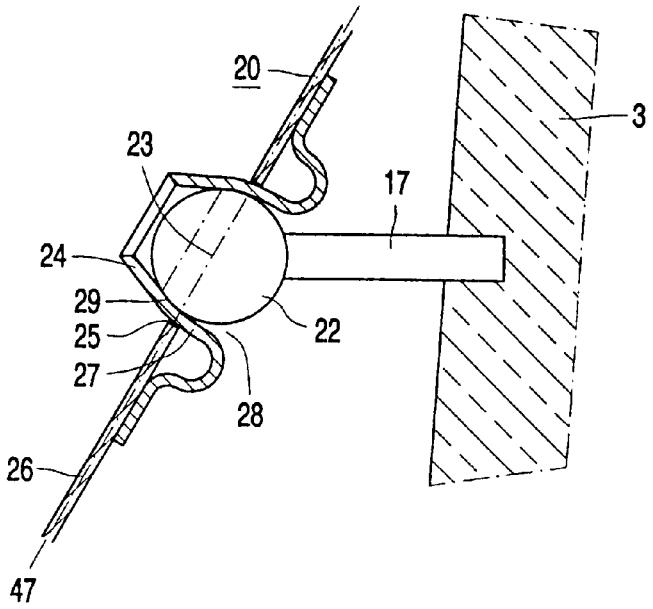
FIG. 4 PRIOR ART
FIG. 4 is a detail of the prior art suspension as shown in FIG. 3.

In FIGS. 3 and 4, the prior art suspension as disclosed in U.S. Pat. No. 4,763,039 is shown. The supporting element 17 is coupled to the upright edge of the display window 3 and is provided with a free end portion 22 for suspending the colour selection electrode 12 by means of the suspension means 20. These suspension means 20 comprise a resilient element 26 and an apertured part 24 protruding from an aperture 25 in the resilient element 26. The suspension means 20 engage the free end portion at contact points 29 which, in this embodiment, are all located—indicated by the dashed line—at a position outside the plane through the resilient element 26. The apertured part 24 acts as a detent, locking the suspension means 20 to the free end portion 22 whose centre 23 substantially coincides with the plane 47 of the resilient element 26. The upright retaining wall 27 causes the entrance opening 28 of the apertured part 24 to be smaller than the diameter of the free end portion 22. When mounting the colour selection electrode 12, the apertured part has to be clamped on the free end portion 22. The colour selection electrode 12 is locked in all four corners to the supporting elements 17 by the spring action of the upright retaining wall 27.

The disadvantage of the system disclosed in U.S. Pat. No. 4,763,039 is the complex structure of the suspension means 20 and the fact that in all four corners the suspension means 20 are locked individually to the supporting elements, which makes the handling of the colour selection electrode 12 very difficult, because during the processing of the screen, i.e. applying, for instance, a black matrix and phosphor layers, the colour selection electrode 12 has to be inserted and extracted several times.

Figure 5:
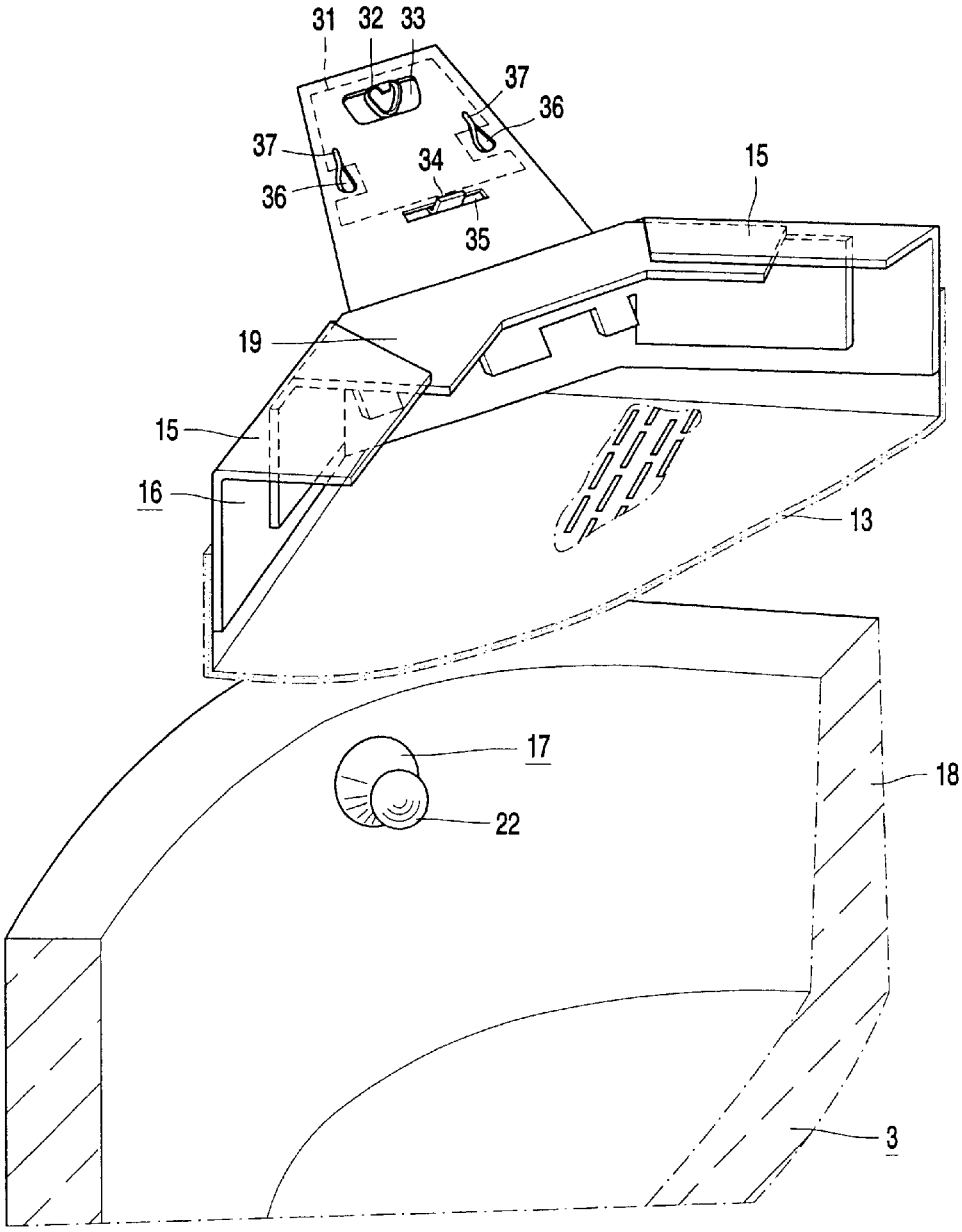
FIG. 5 is a perspective view of the corner area of the display window and the corner section of the colour selection electrode according to the invention.
Figure 6A:
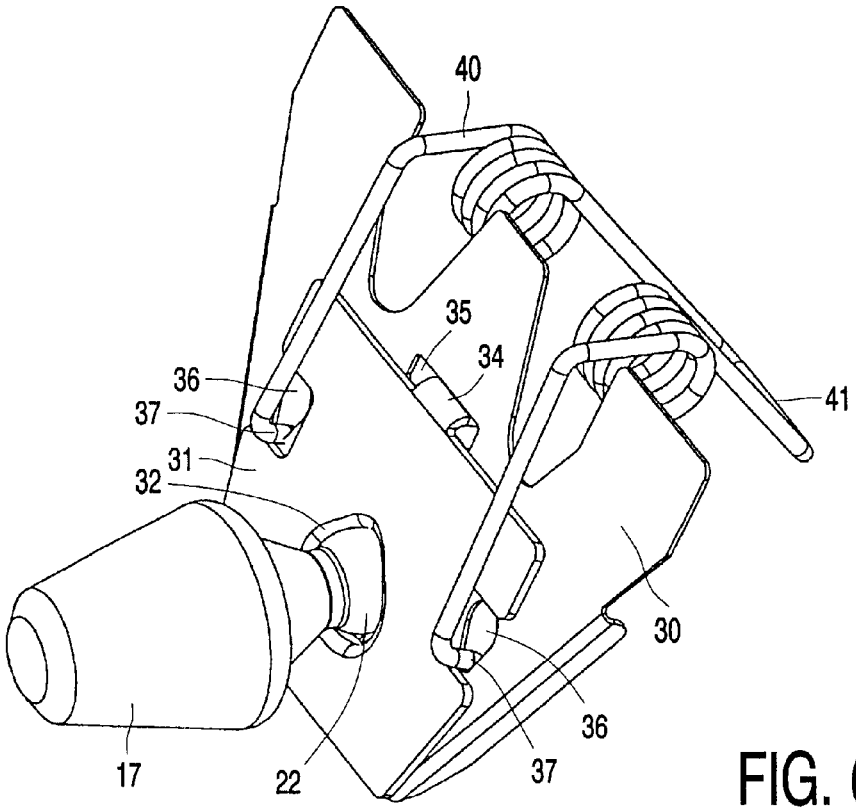
FIGS. 6A–6B show the construction of the apertured part, the resilient element, the spring element and the supporting element.
Figure 6B:
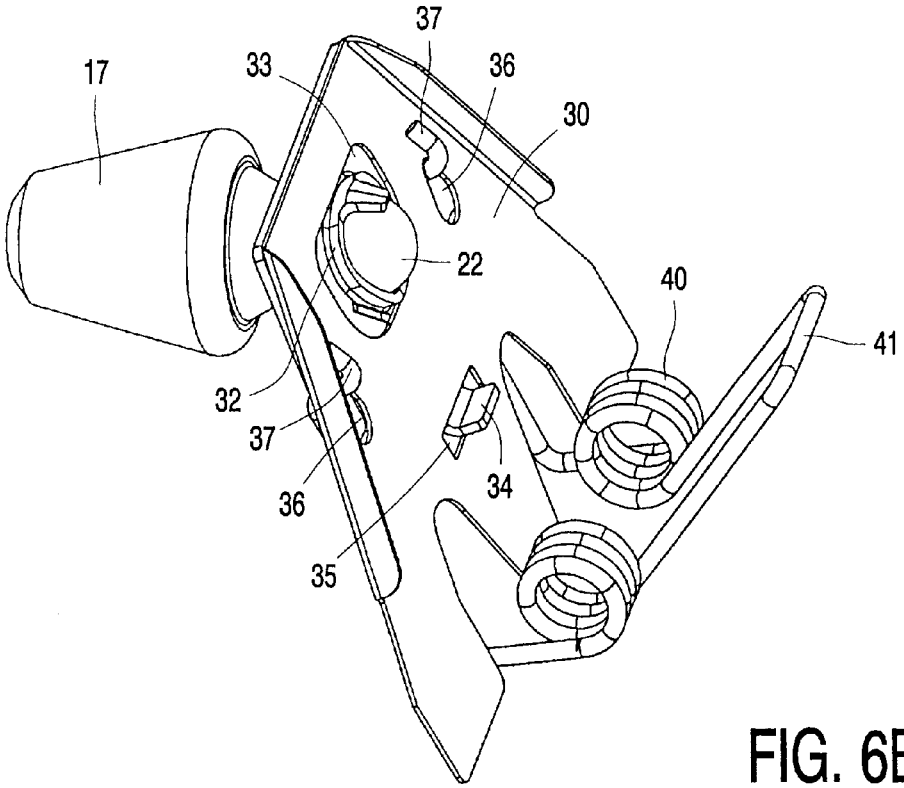

A detailed view of the corner area 18 of the display window 3 and the corner section 16 of the colour selection electrode 12 is given in FIG. 5. The suspension means 20 comprise a flat resilient element 30 to which a flat portion 31 is coupled. This flat portion incorporates an apertured part 32 for engaging the free end portion 22 of the supporting element 17. The flat portion 31 is positioned with respect to the resilient element 30 by the oblong aperture 33 in the resilient element 30 from which the apertured part 32 protrudes and by the supporting lip 34 of the flat portion 31, which projects from the slit-shaped aperture 35. The resilient element 30 has been provided with a wire-wound spring 40 (see FIG. 6) in order to make sure that the colour selection electrode 12 is mounted in the display window 3 with a force that is sufficiently large to generate a reliable connection between the colour selection electrode 12 and the supporting elements 17. The ends 37 of the spring 40 protrude from apertures 36 in the resilient element 30 to simultaneously hold the flat portion 31, while the other end 41 of the spring 40 is connected to the rigid portion 19. FIGS. 6A and 6B are a perspective view of the suspension means 20, that is, the resilient element 30, the flat portion 31 and the wire-wound spring 40, as described in the preceding paragraph that relates to FIG. 5. The FIGS. 6A and 6B give a more detailed impression; for clarity reasons they include the supporting element 17 which is positioned in the apertured portion 32. The flat portion 31 can shift with respect to the resilient element 30; this freedom is used for compensating small errors in, for instance, the positioning of the supporting elements 17 in the upright edge 18. After the colour selection electrode 12 has been inserted into the display window 3 for the first time, the flat portion 31 is rigidly secured to the resilient element 30, which may be done by welding.

Figure 7A:
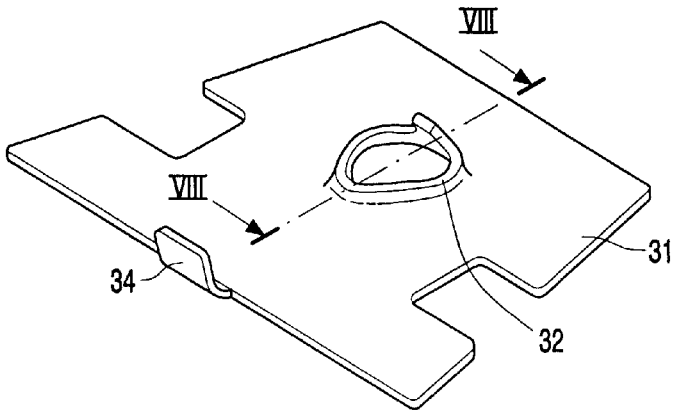
FIGS. 7A–7C show the apertured part as a whole (7A) and in detail (7B–7C)
Figure 7B:
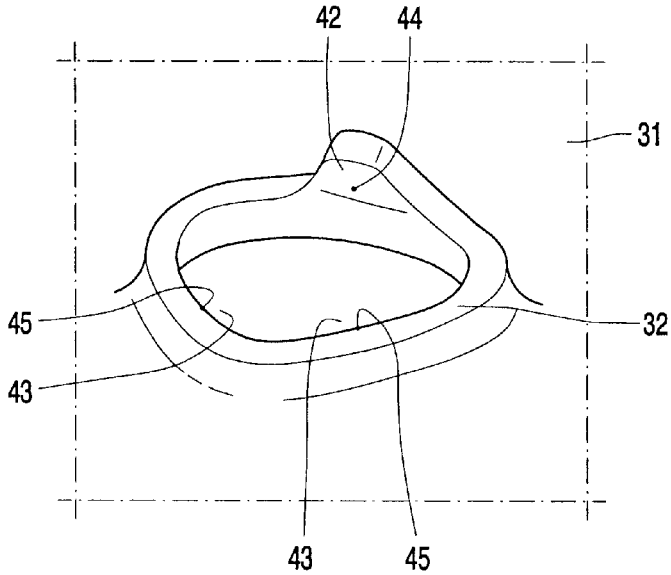
Figure 7C:
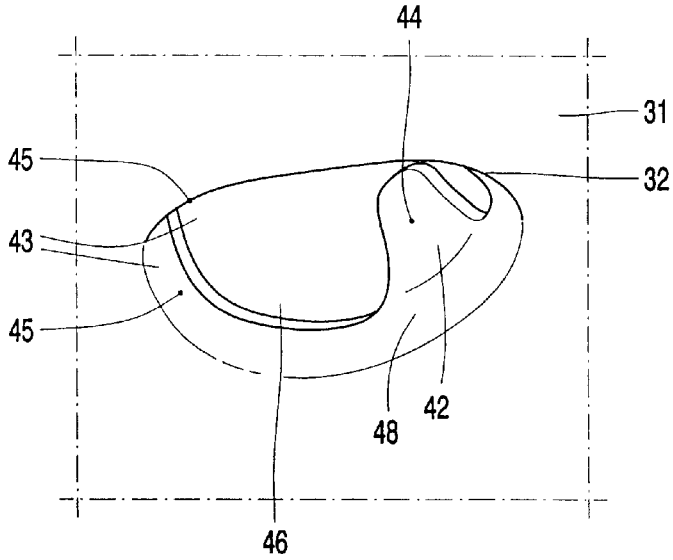

A detailed illustration of the flat portion 31 is given in FIGS. 7A–7C. FIG. 7A shows the entire flat portion, while FIGS. 7B and 7C only show the part of the flat portion 31 that comprises the apertured part 32. By way of example, the apertured part 32 of this embodiment is provided with three surfaces of engagement 42, 43. At these surfaces of engagement, the free end portion 22 makes contact—when the colour selection electrode 12 is mounted in the display window 3—with the contact points 44, 45. Two of the contact points 45 are located in the plane of the flat portion 31, and the corresponding surfaces of engagement are perpendicular to this plane. The third contact point 44 is outside the plane of the flat portion 31, and the corresponding surface of engagement is oriented obliquely angle with respect to said plane, such that the direction perpendicular to the surface of engagement is substantially the same as the direction from the contact point 44 to the centre 23 of the free end portion 22 (not shown in the Figure).

FIG. 7C shows the apertured part 32 from the side where the free end portion 22 will penetrate. The dimensions of the entrance opening 46 are such as to give unobstructed passage to the free end portion 22. The surface of engagement 42 situated on the other side of the entrance opening subsequently detains the free end portion 22 and positions the free end portion 22 against the three surfaces of engagement 42, 43 at the location of the contact points 44, 45. This enables the colour selection electrode 12 to be mounted on the supporting elements 17 without applying clamping forces, and hence without creating loose particles. The friction between supporting element 17 and the suspension means 20 remains low, ensuring a good positional stability of the colour selection electrode 12.

Figure 8C:
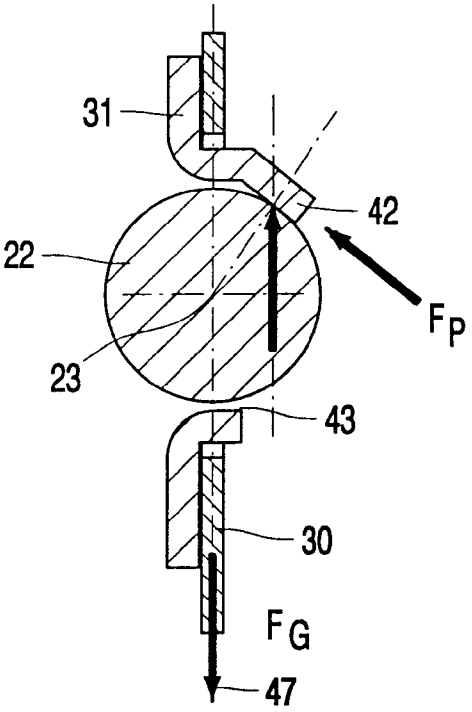
FIG. 8 illustrates the functionality of the self-locking principle.
Figure 8B:
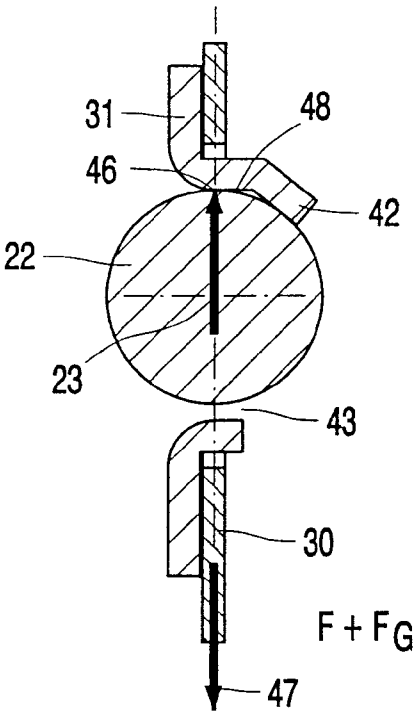
Figure 8A:
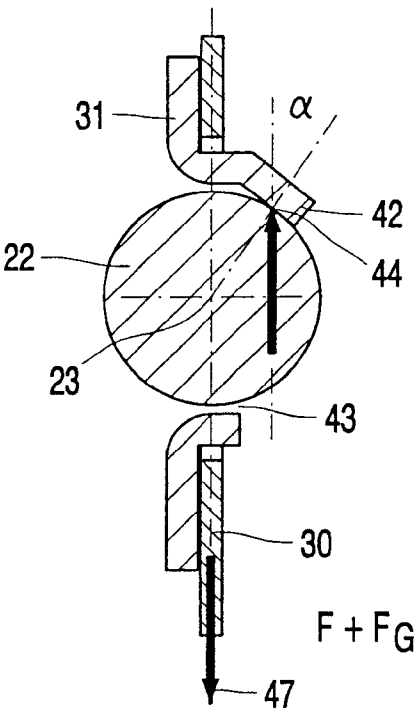

The self-locking principle of this suspension system is illustrated in FIG. 8. FIGS. 8A, 8B and 8C are cross-sectional views of the flat portion 31 taken on the line VIII indicated in FIG. 7A. Due to the fact that the apertured part 32 is slightly triangularly shaped in order to obtain three contact points 44, 45, the free end portion 22 does not make contact with the apertured part 32 in the cross-section at a location opposite the contact point 44. The self-locking principle is based on the fact that a contact—for instance, between the free end portion 22 and a surface of engagement 42, 43—is independent of friction as long as the force stays perpendicular to the contact surface.

In general, a colour display tube 1 is most sensitive to shocks when its display window 3 is oriented downward. Although this is of course not a viewing condition, this situation should be taken into account, because it occurs during production and transportation. In this case, when the colour display tube 1 is in rest, only the force of gravity acts on it. In FIG. 8A the force of gravity is indicated by $F_g$. In the self-locking construction shown as an example in FIGS. 6 and 7—that is with two contact points 45 in the plane 47 of the resilient element 30 and one contact point 44 outside that plane 47—only the action of contact point 44 depends on the friction between the free end portion 22 and the surface of engagement 42. The forces on the contact points 45 are oriented in the plane 47 of the resilient element 30 and can not lead to a displacement of the suspension means 20 with respect to the free end portion 22 that is transverse to the plane 47. In order to make sure that in the position of rest the colour selection electrode 12 does not become detached from the supporting elements, the friction force must be larger than the force of gravity. This is realized when friction coefficient $\mu$ is larger than $\tan(\alpha)$ with $\alpha$ as indicated in FIG. 8A.

In case the colour display tube 1 is exposed to extraneous shock loading an additional force acts on the resilient element 30, which force is oriented in the plane 47 through the resilient element 30. This additional force is indicated by F in FIG. 8A. If this force is large enough, it will exceed the friction at the contact point 44 between the free end portion 22 and the surface of engagement 42 and the surface of engagement 42 will no longer lock the free end portion 22. As a consequence the suspension means 20 will become detached from the free end portion until the shift is stopped by the surface of engagement 48 (see also FIG. 7C) in the upright wall of the entrance opening 46; this situation is given in FIG. 8B. In this position, the contact between the free end portion 22 and the surface of engagement 48 is independent of the friction between them. The preload on the suspension means 20, which is caused by the resilient element 20 and the spring 40 now ensures that the suspension means are repositioned with respect to the free end portion 22, establishing the original situation as shown in FIG. 8C.

This self-locking action as illustrated by FIG. 8 can be summarized by the words 'slipping' (FIG. 8A), 'locking' (FIG. 8B) and 'repositioning' (FIG. 8C).

By making use of a self-locking suspension means 20, the suspension of the colour selection electrode 12 fulfils the requirements with respect to a good positional stability, because no clamping forces are present between the free end portions 22 and the suspension means 20, keeping the friction forces between them at a low level. Furthermore by virtue of this self-locking system, rigidly securing the suspension means 20 to the free end portions 22, for instance by welding, can be dispeased with. This makes it possible to reclaim the colour selection electrode 20 in case of a failure of the colour display tube 1 and reuse it, which leads to cost savings in the production process.

Figure 9A:
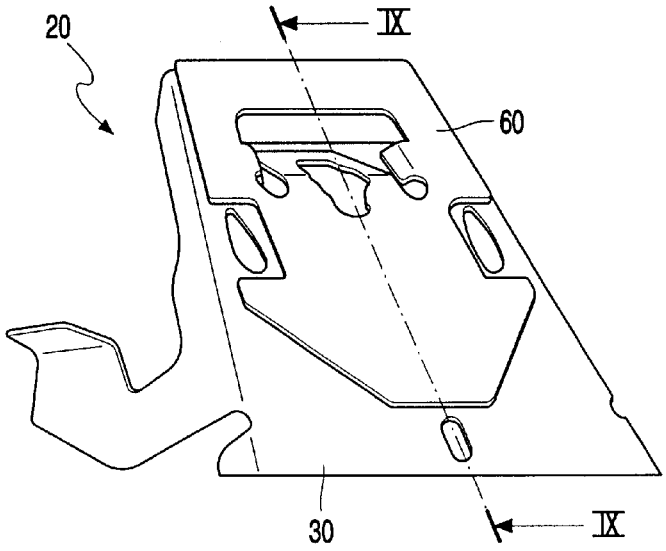
FIG. 9 is an alternative embodiment of the invention.
Figure 9B:
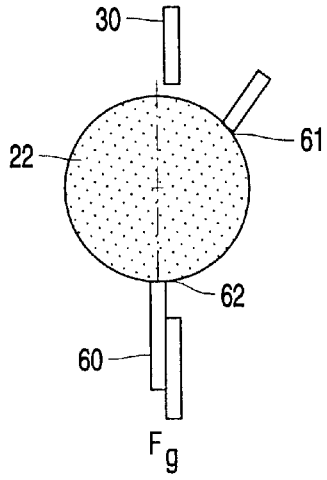
Figure 9C:
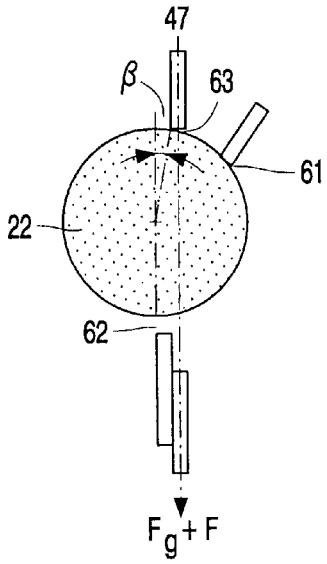

It will be clear to a person skilled in the art that this invention is not limited to the examples given here. Alternative measures and embodiments for creating a self-locking suspension system enable the same objectives to be achieved. An example of an alternative embodiment is given in FIG. 9. FIG. 9A shows a part of the suspension means 20. The flat portion 31 with the apertured part 32 has been replaced by the washer plate 60. As is apparent from FIGS. 9B and 9C, the function of the surfaces of engagement 43 is transferred to the edges 62 of the washer plate 60 and the function of the surfaces of engagement 42 is taken over by the edge 61 of the washer plate 60. FIG. 9B shows the rest position; after applying a force F in the direction of the resilient element 30, the situation of FIG. 9C occurs, where the free end portion 22 is locked against the edge 63 of the resilient element. The preload or the resilient element 30 and the spring 40 will cause the suspension means 20 to resume its original position. This construction is slightly less favourable than the preferred one, because in the 'locking' position of FIG. 9B an angle β remains between the plane 47 of the resilient element 30 and the line through the contact point 63 and through the centre 23 of the free end portion 22, which makes the self-locking function slightly weaker.

Furthermore, the invention is not limited to a colour selection electrode 12 having a corner suspension system comprising corner sections 16 and diaphragm parts 15. The invention is, for instance, also applicable to a corner suspension system comprising a ring-shaped frame with suspension elements coupled to this frame.

The invention has been described for a suspension system in which the free end portion 22 is coupled to the supporting element 17 and in which the self-locking construction is part of the suspension means 20. Evidently, the invention can also be applied to suspension systems with a self-locking system coupled to the supporting means and a free end portion coupled to the suspension means.

In summary, a colour display tube 1 is disclosed which comprises an improved suspension system of the colour selection electrode 12. The colour display tube has suspension means that are constructed so as to be self-locking. The suspension means 20 are provided with an additional flat portion 31. This plate has an aperture 32 that is shaped such that it has at least three surfaces of engagement 42, 43 for the free end portion 22 of the supporting elements 17 which are connected to the inside of the upright edge 18 of the display window 3. When the colour display tube is exposed to shock loading, the construction of the flat portion 31 is capable of absorbing this shock without the colour selection electrode 12 becoming detached from the supporting elements 17. The action is based on the friction between the surfaces of engagement 42 and the free end portion 22. When a force is applied in the plane 47 of the resilient element 30, the suspension means 20 slip from their rest position and are locked by a surface of engagement 48, whereby the preload caused by the resilient element 30 and the spring 40 will cause the suspension means 20 to resume its original position. In this manner, a colour display tube 1 with a good positional stability of the colour selection electrode 12 is obtained. Furthermore, the colour selection electrode 12 can be reclaimed in case the colour display tube 1 is rejected, because there is no need to weld the suspension means 20 to the free end portions 22 anymore.

What is claimed is:

1. A colour display tube comprising a display window with corner areas, a colour selection electrode having corner sections with supporting elements, each of which includes a free end portion, and suspension means, each comprising a generally flat resilient element and a generally flat portion that flushly mates to the resilient element and that includes an apertured part having an entrance opening, wherein the colour selection electrode is suspended from said free end portions, each of which is engaged with an associated apertured part by three contact points which are located on surfaces of engagement, and such that each free end portion has a centre which substantially coincides with a plane through an associated resilient element, wherein at least one of the contact points of each apertured part is situated outside the plane of the associated resilient element and on a surface of engagement, wherein at least one of the other two contact points of each apertured part substantially coincides with the plane of the associated resilient element, wherein at least one of the other two contact points is located on a surface of engagement that is substantially perpendicular to that plane, and wherein the surface of engagement of said contact point that is situated outside that plane is substantially perpendicular to a line between the contact point that is situated outside of that plane and the centre of the associated free end portion, which free end portion passes through the associated entrance opening.

2. A colour display tube as claimed in claim 1, wherein engagement between each apertured part and each free end portion is self-locking.

3. A colour display tube as claimed in claim 1 or 2, wherein a friction force arises between the surface of engagement of the contact point that is outside the associated plane and the free end portion when a force is applied along the flat portion.

4. A colour display tube as claimed in claim 1, wherein two contact points substantially coincide with the associated plane.

5. A colour display tube as claimed in claim 1, wherein the free end portions are substantially spherical.

6. A corner section for use in a colour selection electrode of a colour display tube, which corner section has suspension means comprising a resilient element having a flat portion incorporating an apertured part with an entrance opening, which apertured part has surfaces of engagement, wherein said corner section can be coupled to a free end portion of a supporting element secured to a corner area of a display window, such that the surfaces of engagement will engage the free end portion at contact points, the apertured part being formed so that at least one of the contact points is outside the plane of the resilient element, on a side facing away from the free end portion, and wherein at least one contact point coincides with a plane of the resilient element, wherein the surfaces of engagement of the contact point that coincides with the plane of the resilient element is substantially perpendicular to said plane, and the surface of engagement of the contact point that is situated outside said plane is substantially perpendicular to a line between that contact point and a centre of the free end portion, which free end portion is allowed free passage through the entrance opening of the apertured part, and wherein the resilient element and the flat portion mate along flat surfaces.

7. A corner section as claimed in claim 6, wherein two contact points substantially coincide with said plane.

8. A corner section as claimed in claim 6, wherein that corner section supports a colour selection electrode.

9. A display tube, comprising:

a glass envelope having a display window with a display window corner;

a supporting element that extends from said display window corner, said supporting element having a free end;

a colour selection electrode having a frame with a frame corner that is attached to the supporting element;

wherein said attachment of said frame corner to said supporting element is made by an assembly comprised of a flat resilient element having a resilient element aperture and of a flat portion having an apertured opening that is aligned with said resilient element aperture, and wherein said flat resilient element and said flat portion mate along flat surfaces;

wherein the apertured opening includes a slightly triangular shaped protruding wall that is dimensioned to form three contact points with said free end; and wherein said three contact points include two contact points in a contact plane that is parallel with a plane of said flat portion, and a third contact point that is situated outside said plane.

10. A display tube according to claim 9, wherein said supporting element includes a spherically shaped free end.

11. A display tube according to claim 9, wherein said flat resilient element is part of said frame corner.

12. A display tube according to claim 11, further including a bias element that biases said flat portion toward said flat resilient element.

13. A display tube according to claim 12, wherein said bias element is a spring.

14. A display tube according to claim 9, wherein said contact plane substantially coincides with said plane through said flat resilient element.

15. A display tube according to claim 10, wherein said spherically shaped object has a center that substantially coincides with said contact plane.

16. A display tube according to claim 9, wherein the attachment assembly is self-locking.

17. A display tube according to claim 9, wherein said flat portion includes a supporting lip that fits into a mating aperture through said resilient element.

18. A display tube according to claim 9, wherein said flat portion is a washer plate.

19. A display tube according to claim 18, wherein said washer plate forms a self-locking attachment with said free end.

20. A display tube according to claim 19, wherein said self-locking attachment is produced by friction.

* * * * *